US008839831B2

(12) United States Patent
Gregal

(10) Patent No.: US 8,839,831 B2
(45) Date of Patent: Sep. 23, 2014

(54) BOAT WATER SUPPLY WINTERIZATION SYSTEM AND METHOD

(76) Inventor: John Gregal, Arlington, VA (US)

( * ) Notice: Subject to any disclaimer, the term of this patent is extended or adjusted under 35 U.S.C. 154(b) by 0 days.

(21) Appl. No.: 13/162,545

(22) Filed: Jun. 16, 2011

(65) Prior Publication Data

US 2011/0308664 A1 Dec. 22, 2011

Related U.S. Application Data

(60) Provisional application No. 61/397,639, filed on Jun. 16, 2010.

(51) Int. Cl.

| | |
|---|---|
| ***B65B 39/00*** | (2006.01) |
| ***B63H 21/38*** | (2006.01) |
| ***B63B 17/00*** | (2006.01) |
| ***F01P 11/06*** | (2006.01) |
| ***F01P 11/02*** | (2006.01) |
| *B63J 2/00* | (2006.01) |
| *B63B 29/14* | (2006.01) |
| *F01P 3/20* | (2006.01) |

(52) U.S. Cl.

CPC ..... *B63H 21/383* (2013.01); *B63J 2002/005* (2013.01); *B63B 29/14* (2013.01); *B63B 17/00* (2013.01); *F01P 11/06* (2013.01); *F01P 3/205* (2013.01); *F01P 2050/04* (2013.01); *F01P 11/0276* (2013.01)

USPC ..... 141/340; 141/96; 141/331; 141/332; 440/88 N

(58) Field of Classification Search

USPC ..... 141/59, 98, 247, 331, 332, 338, 340; 440/88 N

See application file for complete search history.

(56) References Cited

U.S. PATENT DOCUMENTS

| | | | | | |
|---|---|---|---|---|---|
| 989,113 | A | * | 4/1911 | Browne | 141/298 |
| 1,942,282 | A | * | 1/1934 | Green | 141/298 |
| 4,271,874 | A | * | 6/1981 | Brady | 141/1 |
| 4,619,618 | A | | 10/1986 | Patti | |
| 4,919,800 | A | | 4/1990 | Vinoski | |
| 4,986,319 | A | * | 1/1991 | Ahlefeld | 141/98 |
| 5,004,024 | A | * | 4/1991 | Rezmer et al. | 141/298 |
| 5,069,259 | A | * | 12/1991 | Ahlefeld | 141/98 |
| 5,071,377 | A | | 12/1991 | Saunders et al. | |
| 6,004,175 | A | | 12/1999 | McCoy | |
| 6,264,517 | B1 | | 7/2001 | Limoli et al. | |
| 6,776,677 | B1 | * | 8/2004 | Knapp, Jr. | 440/88 N |
| 6,908,089 | B1 | * | 6/2005 | Stark et al. | 280/47.31 |
| 7,036,534 | B2 | * | 5/2006 | McClure | 141/9 |
| 7,096,892 | B2 | * | 8/2006 | Tawa | 141/35 |
| 7,309,266 | B2 | * | 12/2007 | Botsaris et al. | 440/88 N |
| 7,404,420 | B2 | * | 7/2008 | Leer et al. | 141/340 |
| 7,997,946 | B2 | * | 8/2011 | Sirmans | 440/88 N |
| 2010/0252141 | A1 | * | 10/2010 | Skaggs | 141/59 |

* cited by examiner

*Primary Examiner* — Timothy L Maust

*Assistant Examiner* — Timothy P Kelly

(74) *Attorney, Agent, or Firm* — KED & Associates LLP

(57) ABSTRACT

A method for winterizing boat engines and a system with components designed for performing the method comprising an air-pressure-supply means that can be used to pressurize the system and thereby force water out the inlet port, an anti-freeze supply means that will supply anti-freeze liquid into the system when the component that is to be winterized is operated to draw water, and means for coupling these components to the water system.

15 Claims, 1 Drawing Sheet

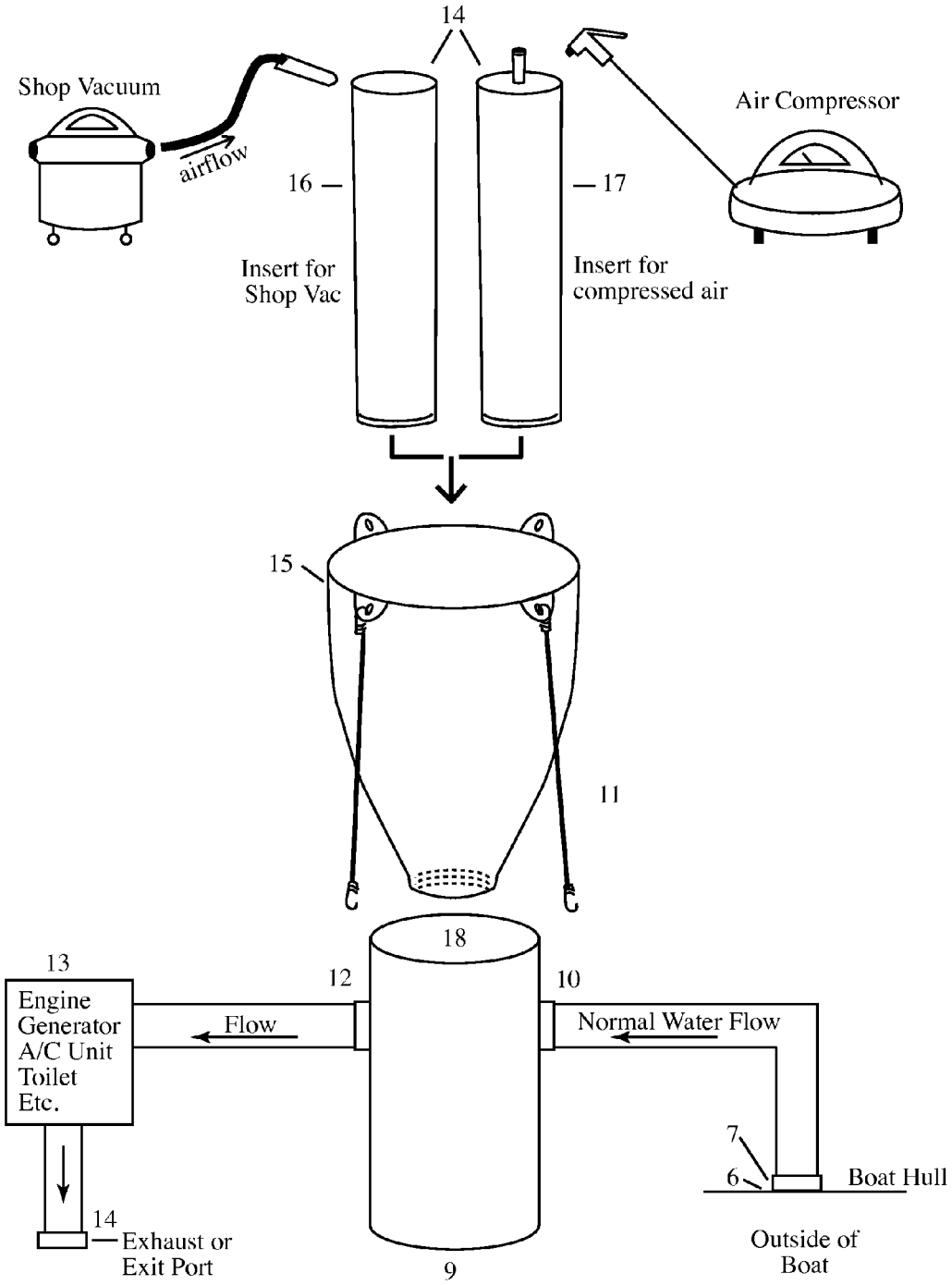
14
Shop Vacuum
airflow
Air Compressor
16
17
Insert for
Shop Vac
Insert for
compressed air
15
11
18
13
Engine
Generator
A/C Unit
Toilet
Etc.
12
10
Flow
Normal Water Flow
7
6
Boat Hull
14
Exhaust or
Exit Port
9
Outside of
Boat

BOAT WATER SUPPLY WINTERIZATION SYSTEM AND METHOD

This application claims priority from U.S. Provisional application 61/397,639 filed Jun. 16, 2010.

BACKGROUND

Boats with inboard motors that are kept in cold climates over the winter and allowed to fall in temperature to below freezing must be "winterized" by flushing out water from seawater intake systems and, usually, replacing the seawater with anti-freeze solution to prevent sea water from re-entering the system. In warmer climates, boats may be "winterized" when they will not be used for a season. This operation typically requires two people, one to operate the pump and another to provide the anti-freeze solution to the right spot at the right time at the right rate.

SUMMARY OF THE INVENTION

This invention addresses two objectives: (1) to flush sea water out, and (2) to supply anti-freeze in a suitable quantity, location, and rate.

In one aspect, the invention is a method for flushing water out of a sea water supply system in a boat, the method involving having in a boat a sea water supply system with an inlet port, an inlet port valve, a water intake hose, a component that requires sea water with a normally closed opening, and an exit port. The steps of the method are: (a) close the inlet port valve; (b) open the opening and couple to the opening an air pressure supply means which applies air pressure to the system; (c) open the inlet port valve and leaving it open until air pressure has forced water out the inlet port and air has begun to escape out the inlet port; and (d) close the inlet port valve.

The component that requires sea water with a normally closed opening may be a water strainer. The opening may be a lid on top of the strainer.

The air pressure supply means may be a tube adapted for coupling a vacuum cleaner hose to the opening or coupling a compressed air supply source, such as a bottle of compressed gas to the opening. The gas may be compressed from the earth's atmosphere and therefore comprise a mixture of gasses typical of air, or it may be predominantly a single gas.

In another aspect, the invention is a method for supplying anti-freeze into a sea water supply system in a boat having a sea water supply system with an inlet port, an inlet port valve, a water intake hose, a strainer having a normally closed opening, a component that requires sea water, and an exit port. The method consists of the steps of (a) opening the strainer opening and coupling to the opening an anti-freeze supply means which supplies anti-freeze as needed for winterization of the system; (b) operating the component that requires sea water to draw anti-freeze into the component, (c) uncoupling from the opening the anti-freeze supply means, and (d) closing the opening.

The opening may be one that supports a lid on top of the strainer. The anti-freeze supply means may be a reservoir sitting on the strainer. The reservoir may have a conical open bottom portion that couples to the strainer opening by protruding into the strainer opening. The reservoir may have an upper opening for receiving anti-freeze that is wider than the conical open bottom portion. The reservoir may be coupled to a spring, such as a bungee cord, that, when installed on the strainer, urges the conical open bottom portion into contact with the strainer.

In another aspect, the invention is a system with components designed for performing the above methods comprising an air-pressure-supply means that can be used to pressurize the system and thereby force water out the inlet port, an anti-freeze supply means that will supply anti-freeze liquid into the system when the component that is to be winterized is operated to draw water, and means for coupling these components to the water system.

The air pressure supply means may be a tube for use with a source of low-pressure gas, such as the outlet of a vacuum cleaner, or a tube for coupling to an air compressor or bottle of compressed gas. The anti-freeze supply means may be a reservoir such as a funnel large enough to hold needed anti-freeze. A spring such as a bungee cord may be used to couple the funnel to an opening of the water system. Threads in the funnel and in the pressurized gas supply tube may allow them to be coupled together.

BRIEF DESCRIPTION OF THE FIGURE

FIG. 1 shows the components of two alternative embodiments of the invention.

DETAILED DESCRIPTION

For purposes of this document, a typical water supply system in a boat comprises, as shown in FIG. 1, an inlet port 6, an inlet port valve 7, a water intake hose 8, a water strainer 9, which has a strainer inlet 10, a strainer opening 18, a strainer outlet 12, a component that requires sea water 13, and an exit port 14. The component that requires sea water might be an engine, a generator, an air-cooling unit, a toilet, or any other component.

The strainer 9 is typically installed at a high point in the system with an opening 18 at the highest point. The allows the strainer lid (not shown) to be opened for cleaning while valves are closed without spilling water into the boat. The invented system and method can be employed in a water system without a strainer provided there is a relatively high point where the system can be opened with a large enough hole that can be coupled to.

The invented system is coupled into the water system, preferably at a relative high point, preferably at the top of the strainer 9 to assist first with flushing sea water out of the system and then supplying anti-freeze solution into the system. It is typically preferable to flush sea water out the component 13 and replace the sea water with anti-freeze.

To accomplish these purposes, the invented system components comprise: an air-pressure-supply means 14 that can be used to pressurize the system and thereby force water out the inlet port, an anti-freeze supply means 15 that will supply anti-freeze liquid into the system when the component 13 is operated to draw water, and coupling means, such as a bungee 11, for coupling these components to the water system opening 18.

The air pressure supply means 14 may be a tube for use with a source of low-pressure gas 16, such as the outlet of a vacuum cleaner, or a tube for coupling to an air compressor or bottle of compressed gas 17. The anti-freeze supply means may be a reservoir such as a funnel 15 large enough to hold all the needed anti-freeze. A spring such as a bungee cord 11 may be used to couple the funnel to an opening 18 of the water system. Threads in the funnel 15 and in the pressurized gas supply tube 14 may allow them to be coupled together.

In preferred embodiments, the funnel 15 is tapered to fit various size sea strainer lid openings 18. The outer surface of the tapered portion of the funnel is coated with a rubber-type material to create a water and air tight seal between the funnel and the opening of the sea strainer.

Bungee cords 11 hook to the funnel and wrap around the inlet 10 and outlet 12 fittings on the sea strainer. This pulls the funnel down into the sea strainer's opening 18 to secure the funnel 15 in place and help create the water and air tight seal between the funnel and the opening of the sea strainer.

The invented system includes two different threaded inserts 14 to accommodate pressurized air. One insert 16 receives compressed air from a shop vacuum (wet-dry vac). The insert for the shop vacuum is hollow and tapered to accept various size shop vacuum hoses. The alternative insert receives air from an air compressor or bottle of compressed gas. The funnel 15 has threads to accept threads on the inserts 14.

METHOD OF USING THE INVENTED SYSTEM COMPONENTS

1. Close the water intake valve to prevent water from entering the boat once the sea strainer (aka raw water filter) lid is removed.

2. Open the sea strainer lid and remove the strainer basket.

3. Place the funnel device down into sea strainer's opening and secure with bungee hooks looping around the filter's inlet and outlet fittings. The rubberized outer skin of the funnel will create a relatively water tight seal between the funnel and the sea strainer's opening.

3A (only necessary for boats that are stored in the water, not stored on land). Screw the appropriate insert (shop vacuum or air compressor) down into the funnel. Blow compressed air down into the strainer and open the water intake valve. Listen/look for bubbles outside the boat. Close valve and stop the compressed air. The water hose up to the sea strainer is now purged of water and thus cannot freeze. (Step 3A can also be performed to clear any debris (seaweed/trash) that may have been drawn up through the boat's through hull fitting, restricting the flow of water. This is another use for the funnel device.)

4. Remove the insert, if used, and prepare several gallons of biodegradable antifreeze to be poured into the funnel. Briefly start the component that is being fed raw water by the sea strainer (e.g. engine, generator, air conditioning unit, or toilet). Immediately pour antifreeze into the funnel until equally colored antifreeze (not diluted by the water in the system) can be seen exiting the boat through the device's exhaust/exit port. Immediately turn off the component so that the raw water pump is not run dry by pumping out the antifreeze. Antifreeze will also flow back and fill the water inlet hose that was purged in step 3A, further assuring it is winterized. The raw water system fed by that sea strainer is now purged of sea water and replaced with antifreeze.

4A. In warmer climates, if the funnel is being used to flush salt water from the system, fresh water can be substituted for antifreeze. Be sure there is sufficient water to keep up with the normal amount of flow for the pump of the engine/generator/Air Conditioning unit/toilet.

5. Remove the funnel from the sea strainer. Replace the strainer basket and secure the strainer's lid.

The winterization/flush process is now complete. To dewinterize, open raw water valve and start the engine/generator/air conditioner/toilet and visually verify the flow of sea water through the sea strainer. The antifreeze left in the bottom of the sea strainer will be replaced with raw water.

Note: For the rare applications where engines/generators are fed cooling water through sea strainers and do not have closed cooling systems, the funnel device can be used to winterize the raw water hoses, sea strainer and exhaust system, but the engine itself will need to be drained of sea water to assure full freeze protection. This is because the engine's thermostat dictates the flow of cooling water (or antifreeze during step 4) through the engine and one cannot be assured of full winterization without knowing that antifreeze was allowed into the engine by the thermostat during step 4.

The invention claimed is:

1. A winterizing system for winterizing a boat component having a sea water system that draws a sea water into the boat component through a port that passes sea water through a hull of a boat, the winterizing system comprising:

(a) a funnel with a tapered open bottom and a wider upper opening, the tapered open bottom adapted to be removably air-tight coupled to an opening in the sea water system, the upper opening side of the funnel adapted to be removably air-tight coupled to an air pressure supply tube, the funnel having no other ports so that, when an air pressure supply tube is air-tight coupled to the funnel and the funnel is air-tight coupled to the opening in the sea water system, there is an air-tight coupling between the air pressure supply tube and the opening in the sea water system, wherein the funnel include female threads that are at the tapered open bottom of the funnel;

(b) an air pressure supply tube that can be removably air-tight coupled to the funnel while the funnel is air-tight coupled to the opening in the sea water system and used to pressurize the sea water system and thereby force water out of the sea water system and the component that is to be winterized through the port that passes sea water through the hull, wherein the air pressure supply tube includes male threads to couple to the female threads of the funnel when the air pressure supply tube is provided within the funnel; and (c) a spring, provided at least at the upper opening of the funnel, for removably urging the funnel into the opening in the sea water system.

2. The winterizing system of claim 1 wherein the air pressure supply tube is a tube adapted for coupling to and receiving compressed air from an outlet of a vacuum cleaner and supplying the air to the funnel and the opening in the sea water system.

3. The winterizing system of claim 1 wherein the air pressure supply tube is a tube adapted for coupling to and receiving compressed air from an air compressor or bottle of compressed gas and supplying the air to the funnel and the opening in the sea water system.

4. The winterizing system of claim 1 wherein the funnel is large enough to hold a substantial part of anti-freeze.

5. The winterizing system of claim 4 wherein the spring for urging the funnel into the opening in the sea water system comprises at least one bungee cord used to couple elastically hold the funnel to the opening of the sea water system and provide an air tight seal.

6. The winterizing system of claim 1 wherein the tapered open bottom of the funnel is of a size to be air-tight coupled to an opening on a top side of a sea strainer.

7. The winterizing system of claim 1 wherein the tapered portion of the funnel is coated with a rubber-type material to create a water and air tight seal between the funnel and the opening of the sea water system.

8. A winterizing system for winterizing a component having a water system that draws sea water into the component, the winterizing system comprising:

a funnel component having a first bottom opening and a second upper opening, the second upper opening being larger than the first bottom opening, the funnel component including first threads at an inside area of the funnel component near the first bottom opening, the first bottom opening to be removably air-tight coupled to an opening of the water system;

a hollow supply tube having a first end portion and a second end portion, the first end portion having second threads, the hollow supply tube to be provided in the funnel component such that second threads to couple to the first threads of the funnel component and thereby provide a seal between the hollow supply tube and the first bottom opening of the funnel component, wherein the hollow supply tube is to receive air at the second end portion and to output the received air at the first end portion of the hollow supply tube; and air-tight sealing means for providing an air-tight seal between an outer lower edge of the funnel component and the opening of the water system by pulling the funnel component in a direction toward the opening of the water system.

9. The winterizing system of claim 8, wherein the first threads at the inside area of the funnel component are female threads.

10. The winterizing system of claim 8, wherein the second threads of the hollow supply tube are male threads.

11. The winterizing system of claim 8, wherein the air-tight sealing means includes a plurality of bungee cords to couple to an upper outer edge of the funnel component.

12. The winterizing system of claim 8, wherein the air-tight means includes at least one bungee cord to couple to an upper outer edge of the funnel component and to couple to a component of the water system.

13. The winterizing system of claim 8, wherein the air-tight sealing means includes at least one spring device to urge the first bottom opening of the funnel component into the opening of the water system.

14. The winterizing system of claim 8, wherein the hollow supply tube is a tapered tube where the second end portion of the hollow supply tube is larger than the first end portion of the hollow supply tube.

15. The winterizing system of claim 8, wherein the funnel component includes a tapered portion coated with a rubber-type material to create a water and air tight seal between the funnel component and the opening of the water system.

* * * * *